United States Patent [19]

Caudle

[11] 4,086,745

[45] May 2, 1978

[54] CASE PACKING APPARATUS

[75] Inventor: Otis M. Caudle, Richfield, N.C.

[73] Assignee: Eggineers, Inc., Richfield, N.C.

[21] Appl. No.: 762,644

[22] Filed: Jan. 26, 1977

[51] Int. Cl.[2] ..... B65B 5/06; B65B 35/50

[52] U.S. Cl. ..... 53/159

[58] Field of Search ..... 53/152, 153, 159, 162, 53/164, 248; 214/6 DK

[56] References Cited

U.S. PATENT DOCUMENTS

| | | | |
|---|---|---|---|
| 2,956,384 | 10/1960 | Underwood | 53/154 |
| 3,014,599 | 12/1961 | Lawrence et al. | 53/164 X |
| 3,067,559 | 12/1962 | Lawrence et al. | 53/164 X |
| 3,105,333 | 10/1963 | Desnick | 53/35 X |
| 3,748,797 | 7/1973 | Deines | 53/152 X |
| 3,837,140 | 9/1974 | Golantsev et al. | 53/159 |

*Primary Examiner*—Robert Louis Spruill
*Attorney, Agent, or Firm*—Richards, Shefte & Pinckney

[57] ABSTRACT

A case packing apparatus for assembling packages or trays of fragile objects, such as eggs or fruit, into layer arrays, assembling the layer arrays into stacks, and depositing the stacks into cases. Packages or trays are transported by a conveyor to a transfer plate on which they are assembled in layer arrays that the transfer plate lifts and deposits sequentially on superposed pairs of opposed retractable support ledges on inner sides of an adjacent stacking cabinet. When a set number of layer arrays has been assembled in the cabinet, the support ledges are retracted sequentially, uppermost first, to cumulatively lower the layer arrays into a solid stack and lower the solid stack onto a pair of flexible aprons extending horizontally from opposite sides of the cabinet and held taut by bowed flat springs each attached at one end to the corresponding cabinet wall below the upper reach of the extended apron and enveloped by the extended outer reaches of the apron. The aprons are formed of flexible sheet material that is wound in rolls supported on the cabinet for unwinding and winding extension and contraction of the aprons, with unwinding permitting the aprons and springs to move downwardly into a case therebelow, thereby gently lowering the supported stack into the case, and allowing easy retraction of the aprons and springs from between the stacks and case walls. A stack stabilizing plate acts on the top of the uppermost array during stack assembly and lowering of the layer arrays.

14 Claims, 12 Drawing Figures

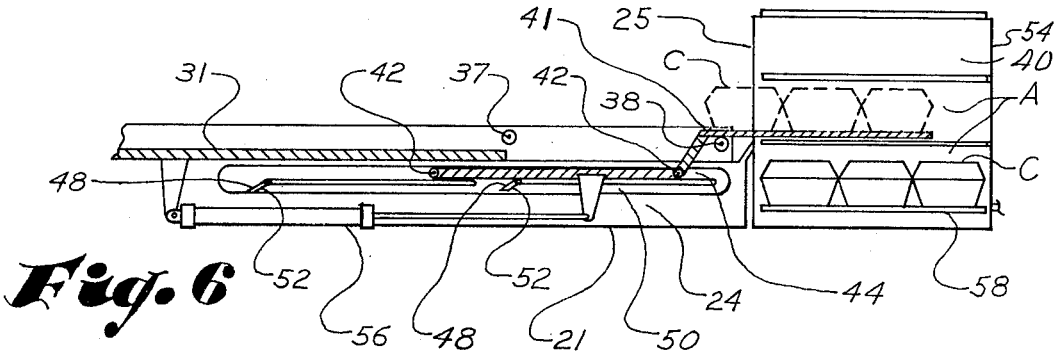
Fig. 6
Fig. 7
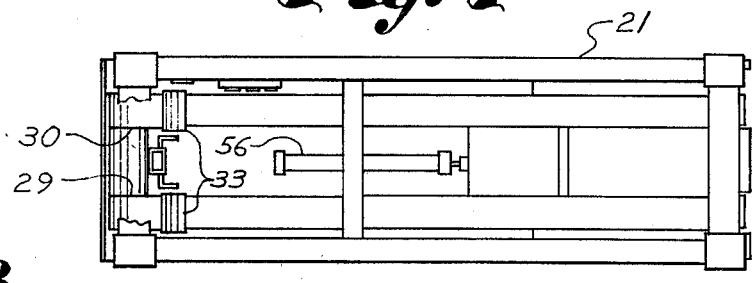
Fig. 8
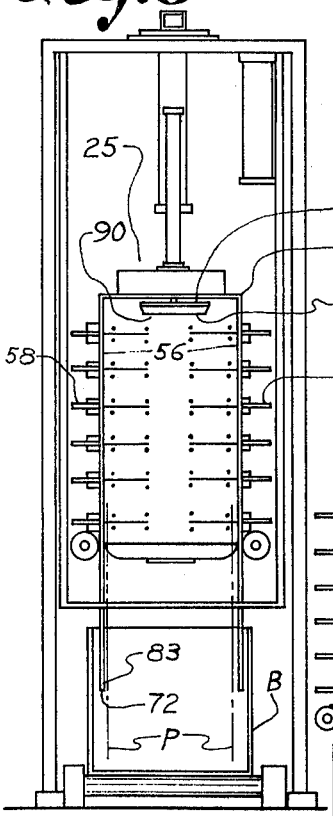
Fig. 9
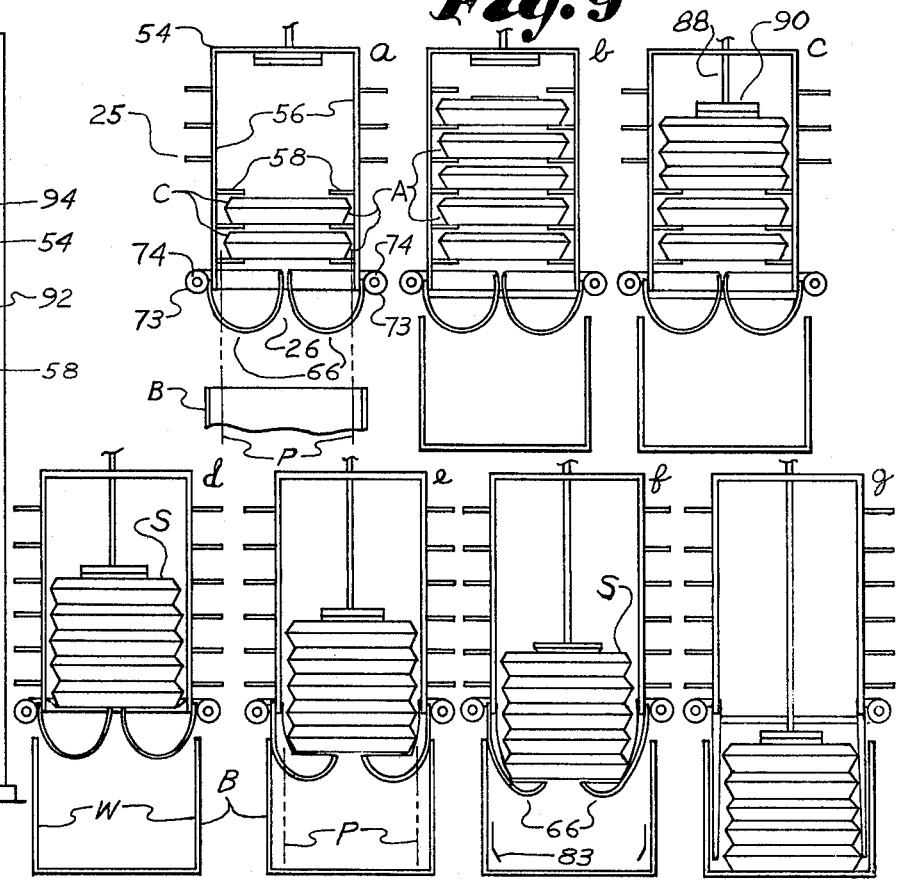

CASE PACKING APPARATUS

BACKGROUND OF THE INVENTION

The present invention relates to object handling apparatus and more particularly to features of such apparatus either singly or in combination for forming objects into stacks, for releasing objects into a case or space, and for reorienting objects as they are being transported.

In handling various objects, particularly objects such as eggs, fruit and other fragile or delicate objects, problems arise in attempting to release them into spaces such as cases where abrupt release or dropping can cause breakage or other damage as it is difficult to provide gentle controlled advance of the objects into the space with an apparatus that can be withdrawn from the space without interference with either the released objects or the structure confining the space as when such objects in cartons or on trays in case-filling stacks are being packed into cases. There is also a problem in handling such objects to form layer arrays as trays or cartons in an assembled stack such as for subsequent case packing.

Representative examples of prior art handling apparatus are shown in U.S. Pat. No. 2,956,384 and U.S. Pat. No. 3,067,559, which disclose the use of flexible resilient strips or sheets that impose a guiding restraint on stacks of cartons or other articles advancing into a case. These strips or sheets project into the path of advance and rely solely on their resiliency to guide and restrain the articles, which can result in misguiding or misalignment due to variations in the resiliency of the strips or sheets or the distribution of the weight of the articles, or due to any previous misalignment of articles as they are delivered to the strips or sheets. Also, the effectiveness of such strips or sheets is substantially reduced when they have been flexed to approach a straight condition along the sides of articles at the point of release, causing problems at the most critical time in handling. These prior apparatus also include the formation of stacks of article layers from the bottom up with subsequent layers being dropped onto the previously closed stack layer formation.

Another prior art example of an apparatus for handling article layers in filling cases in U.S. Pat. No. 3,105,333, which discloses bottom up formation of stacks and lowering of the stacks on deformable article engaging and holding members that project under the stack until the stack is in position in a case and then retract by flexing into supporting side members. As in the other prior art examples there is no control of the flexing of the article engaging and holding members to positively prevent misalignment or misguiding particularly during the critical last stage of flexing for article release, and this arrangement requires movement of the supporting side members into the case, which complicates the construction and operation and increases the space occupied in the case with a resulting limitation in the potential case filling utilization of the articles.

In contrast, the present invention provides an apparatus for releasing objects into a space using a flexible extent that is positively controlled during article engagement and through release so that possible misguiding and misalignment are avoided, and this is accomplished with an arrangement that is capable of easy retraction from a space or case while occupying a very thin space that does not significantly minimize the possibility of a case-filling arrangement of objects. The present invention also provides an apparatus that functions to assemble objects in layer arrays that are formed into stacks in a top down sequence for delicate and simple handling. Another feature of the present invention not provided by the prior art is a capability of reorienting selected trays or other arrangements of objects by pivoting prior to assembly into stacks so that the objects can be assembled in a desired relative orientation different from that in which they are initially provided, as when it is desired to reorient alternate trays at right angles to the other trays in forming a stack.

SUMMARY OF THE INVENTION

Briefly described, in one form the present invention is incorporated in a case packing apparatus having means for releasably supporting a plurality of objects in vertically spaced layers above an object-receiving case, means for manipulating the supporting means to lower the spaced layers of objects sequentially from the top down to form a solid stack above the case, and means for lowering the stack into the case and releasing the stack thereinto, with the stack lowering means being retractable from the case after releasing the stack. The apparatus may include means for transporting objects to a transfer location, means for holding objects at the transfer location in a layer array, and means for transferring layer arrays from the transfer location onto the aforementioned supporting means.

In the preferred embodiment of this first form of the present invention, the releasably supporting means includes sets of retractable support members superposed in positions in a vertically movable stacker cabinet. The support members in each set are spaced apart to accommodate movement of the transfer means therebetween for transfer of objects thereto.

In another form of the present invention, which may be combined with the form described hereinabove, the present invention is incorporated in apparatus for releasing objects into a space and includes object engaging means having a flexible extent disposed for releasably restraining objects in a path of delivery to the space. The flexible extent has an end disposed adjacent the path of delivery and an other end positionable in the path of delivery, with the flexible extent being flexible between its ends for object restraining deflection partially about objects in the path upon engagement therewith. Movable means are included for supporting the other end of the flexible extent in the path of delivery and is operable to position the other end progressively downstream and outwardly with respect to the path of delivery to a position out of the path for advance of the deflecting object engagement progressively downstream and ultimately out of engagement with objects, thereby providing progressive delivery and ultimate release of objects into the space. Preferably, the flexible extent is formed of flexible sheet material and is extendable from the end of the extent adjacent the path of delivery, the movable means is in the form of a thin flat spring having a fixed end portion secured adjacent the delivery path generally parallel therewith and having a movable end portion engaged by the flexible web material at the end of the flexible extent that is positionable in the delivery path, and means are provided for varying the flexible extent to cause bowing and unbowing of the spring to position the flexible extent in and downstream out of the delivery path with the extended flexible extent being generally flat with the spring.

The preferred embodiment of this form of the present invention is a case packing apparatus wherein the object engaging means includes a pair of opposed flexible extents disposed for releasably restraining objects in a vertical path of delivery to a case, with the aforesaid other end of the flexible extent being movable progressively downstream and outwardly with respect to the path of delivery and into the case to a position out of the path and along the walls of the case. In this embodiment, the means for varying the flexible extents includes rolls of the flexible sheet material disposed adjacent the delivery path for providing the flexible extents, with means for unwinding and winding the rolls to extend and retract the flexible extents.

A further embodiment of the present invention that may be combined with the preceding forms is an apparatus for forming and releasing stacks of objects including a plurality of sets of retractable support members superposed in positions for receiving and supporting a plurality of objects in vertically spaced-apart layers, and control means for sequentially retracting the support members laterally from the supporting positions for each layer in descending order so that an accumulated solid stack of objects is released by the retraction of the support members for the lowest layer. In the preferred embodiment of this form of the invention means are included for transferring objects onto the support members in consecutive layers, with the support members in each set being spaced apart and the transfer means including a transfer plate that is disposed at a ready position and movable upwardly therefrom to pick up objects, thence movable to transfer objects thereon to a position above and between the support members, thence movable to a position below and between the support members for deposit of the objects thereon, and finally movable back to the ready position, with means being included for moving the transfer plate as described. In this preferred embodiment, a stack stabilizing member is provided in the form of a horizontal plate having a pad of resilient material attached to its underside the engagement with the uppermost layer and means are provided for maintaining the stack stabilizing member in engagement with the top of the uppermost layer of objects during stack forming sequential lowering of the layers, which maintaining means is a pressurized piston-cylinder mechanism acting downwardly on the plate to maintain a stack stabilizing pressure therethrough onto the stack.

An additional form of the present invention that may be combined with any of the foregoing forms is means for transporting objects including a pair of parallel conveyor belts for supporting and conveying common objects, means for driving the belts to convey objects thereon, and means for controlling the driving means to drive one of the belts while temporarily stopping the other of the belts to cause pivoting reorientation of the object being transported. In the preferred embodiment of this form of the invention, a cam member is disposed under the driven belt to elevate the belt for enhanced frictional engagement to assure movement of the object with the moving belt, and means are included for sensing objects in position for pivoting reorientation, with the control means being operable to effect pivoting reorientation of alternate objects sensed by the sensing means while allowing other objects to be transported without reorientation.

BRIEF DESCRIPTION OF THE DRAWINGS

FIG. 6 is an enlarged sectional view of the central portion of FIG. 5;

FIG. 7 is a bottom view of the conveyor section of FIG. 5;

FIG. 8 is a front elevational view of the case packing apparatus of FIG. 1 with a conveyor section removed;

FIG. 9 is a partial front elevational view of the case stacking apparatus of FIG. 8, showing in eight panels the progressive steps of accumulating a stack of egg cartons and delivering it into a case;

DESCRIPTION OF THE PREFERRED EMBODIMENTS

Figure 1:
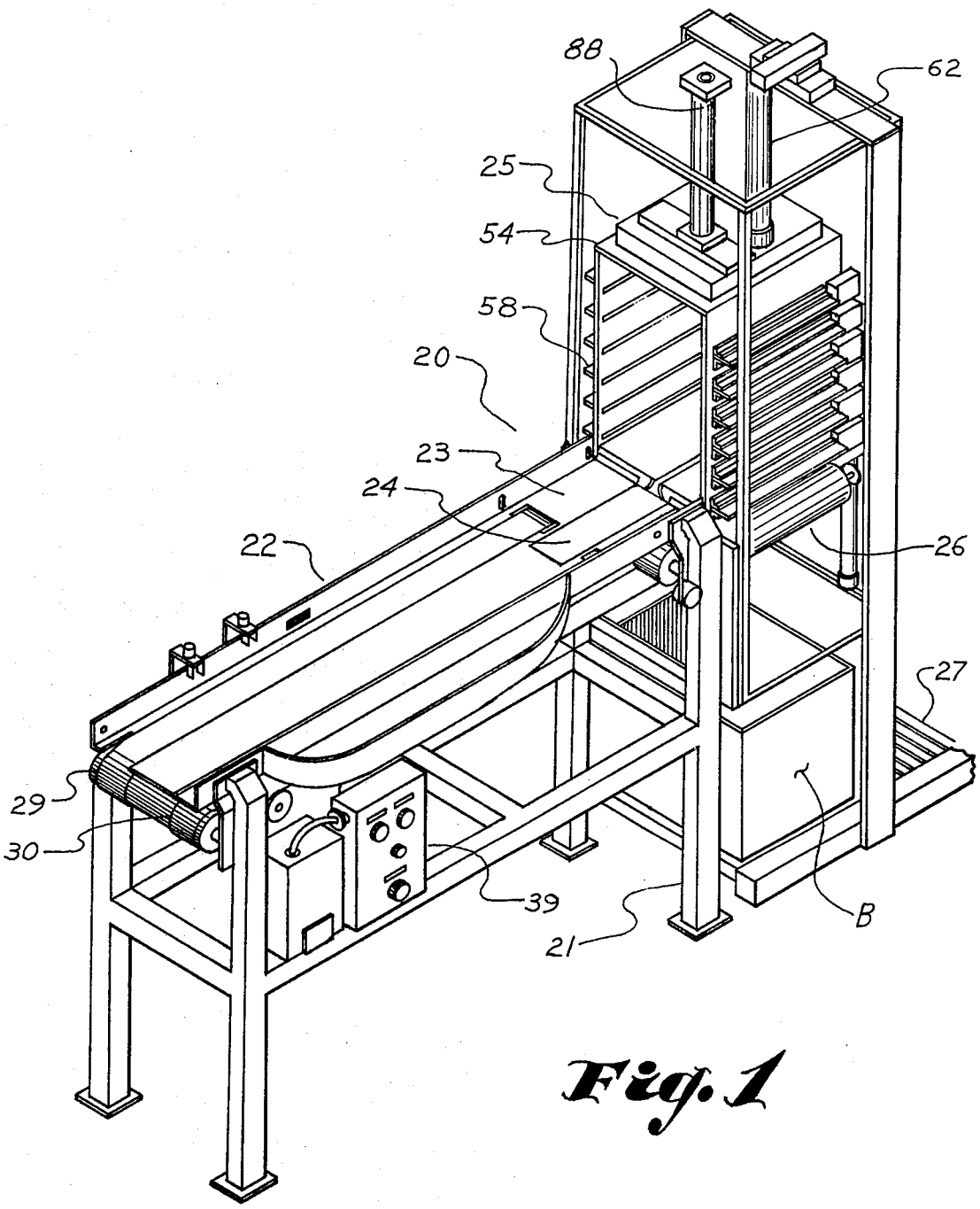
FIG. 1 is a perspective view of a case packing apparatus incorporating the preferred embodiments of the several forms of the present invention.
Figure 4:
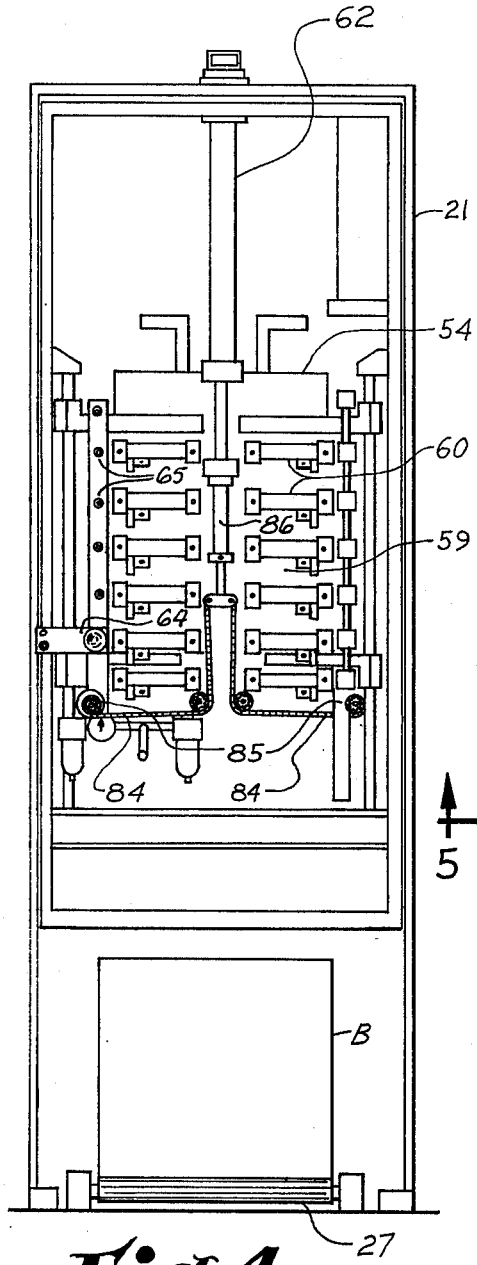
FIG. 4 is a rear elevational view of the case packing apparatus of FIG. 1.
Figure 2:
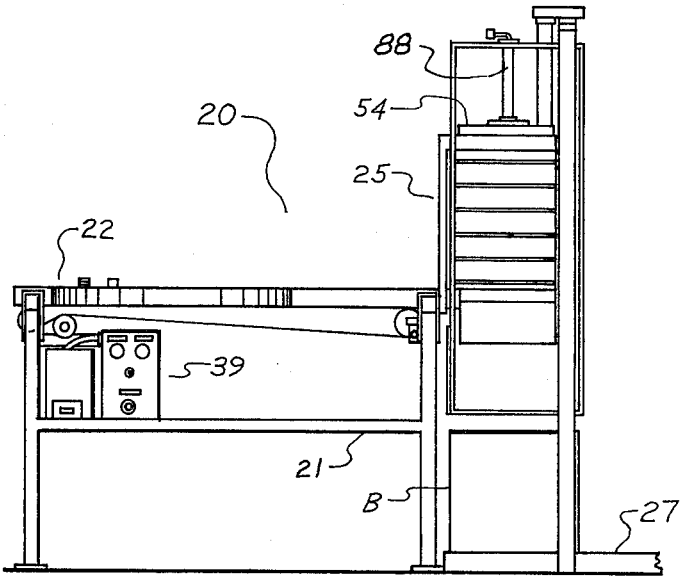
FIG. 2 is a right side elevation view of the case packing apparatus of FIG. 1.

The present invention is applicable to apparatus and means for handling various types of objects and particularly fragile or delicate objects that require particular care to avoid breaking or damage. Objects such as eggs, apples, pears, avocados, other fruits, and similarly delicate objects are handled effectively by the apparatus and means of this invention. By way of example, the preferred embodiment of the present invention illustrated in the drawings and described herein is adapted to the handling of eggs and is in the form of an egg case loader that handles eggs in cartons or on trays to automatically assemble stacks of cartons or trays and fill cases with the assembled stacks.

In the processing of hen eggs as delivered by an egg producer to an egg processing plant on flat trays, each normally holding thirty eggs in a predetermined pattern for marketing, it is customary to feed the eggs on these "filler flats" to a machine which automatically picks up the eggs and places them on a conveyor which carries them through a washing process to a candling station where the eggs are inspected visually while backlighted, with any defective eggs being removed manually. The eggs are then transported farther, to grading stations where automatic mechanisms sort the eggs into predetermined weight ranges and deposit them onto various conveyors corresponding to the respective weight ranges. The eggs on each of these conveyors are carried to a separate packaging station where they are automatically picked up, oriented to put the larger ends up, deposited either into 12-egg cartons or onto 30-egg flat trays. In the case of cartons, the lids are closed. Then, in either case, a separate conveyor at each station carries the cartons or flats to the end of the conveyor to be manually packed into cases or baskets.

Three cartons or one "flat" form a layer in either a case or basket, snugly filling the horizontal areas thereof, with five layers of cartons or six layers of "flats" filling a case or basket vertically. Conventionally such case filling has been done by hand because of the difficulty of providing a mechanism that can gently lower the cartons or trays into a case and yet be of a configuration that does not occupy any significant space that would prevent full capacity filling of the space in the case and could be readily removed from the close confines between packages and case. In such manual packing operations, the people involved must be constantly at work when a grading line is operating, being careful that no eggs are broken in manually filling cases, which is hard, monotonous, machine-paced physical work that is largely unsatisfying to the typical worker.

Further, in handling the 30-egg "flats," which are square in flat-wise shape and have a patterned surface for holding the eggs arranged in five rows of six eggs each, the resulting rectangular pattern of eggs causes the underside of the "flats" to nest in interlocking fashion with eggs in the "flat" below when the egg-loaded "flats" are superposed at right angle differences in orientation. This has typically required manual manipulation to effect proper orientation.

This case-packing apparatus of the present invention simulates the gentleness of manual case loading with a device which collapses to exceeding thinness for easy removal from the confines of the case and further provides other novel arrangements for assembling and delivering case-filling solid stacks of egg-filled packages to the cases.

The illustrated preferred embodiment of the present invention is in the form of an egg case packing apparatus 20 that has a main frame 21 on which are mounted means 22 for transporting cartons C or trays T from a supply line (not shown), means 23 for holding cartons or trays received from the transporting means 22 in a layer array A, means 24 for transferring layer arrays from the holding means to means 25 for forming and releasing a stack S of layer arrays, and means 26 for lowering a formed stack into a case B and releasing the stack therein. Filled cases B are removed from under the frame 21 on a roller conveyor 27 or other suitable means on which empty cases for filling are subsequently advanced into position below the lowering and releasing means 26, all as shown in FIG. 1.

Figure 11:
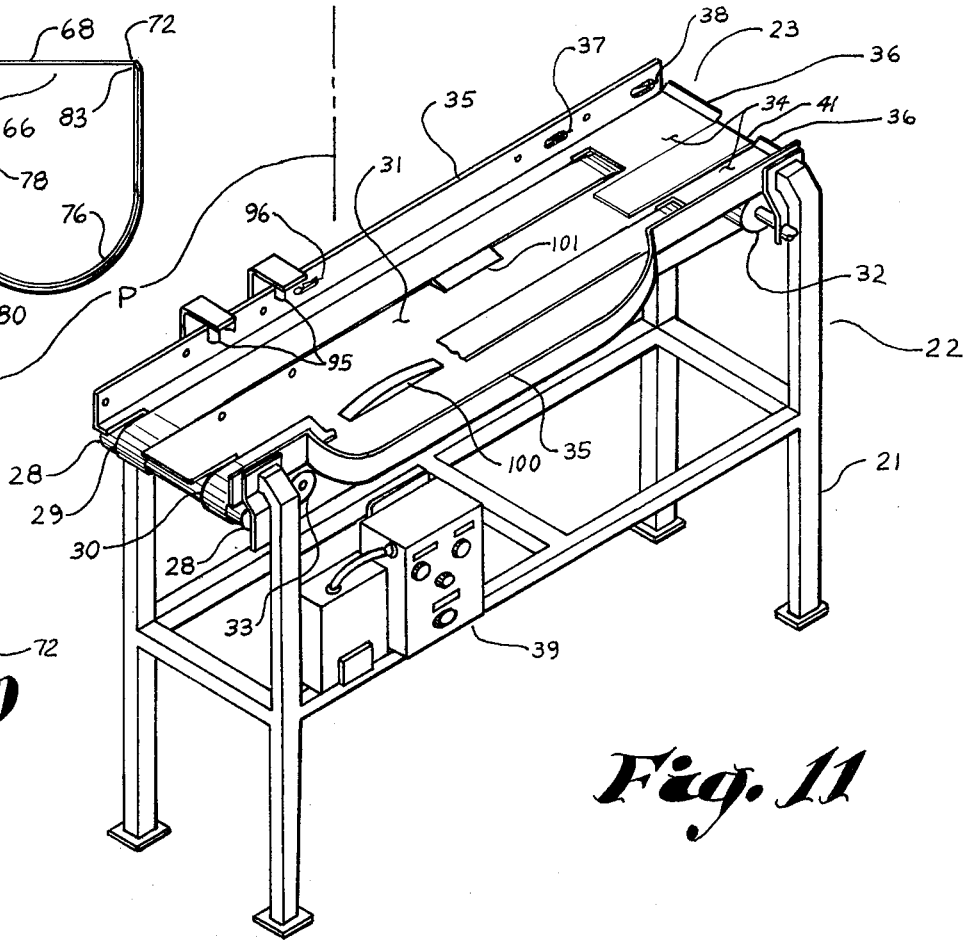
FIG. 11 is a perspective view, partially cut-away, to show details of the conveyor section of FIG. 1.
Figure 12:
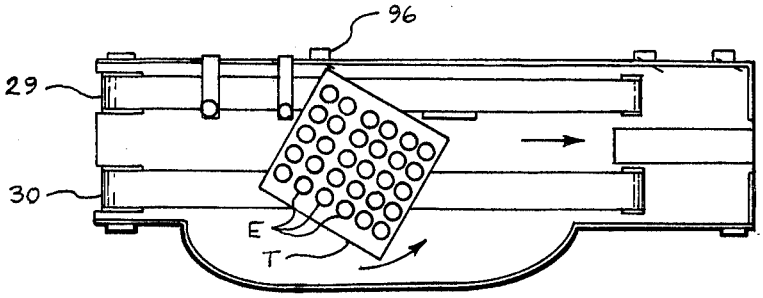
FIG. 12 is a plan view of the conveyor section of FIG. 11 showing the re-orientation of a flat tray full of eggs.

As shown in FIG. 11, the means 22 for transporting objects to a transfer location includes two integral electric motor-pulley units 28 mounted on frame 21 for driving right and left hand endless conveyor belts 29 and 30 in parallel relation over a horizontal support plate 31 and over two pulleys 32 mounted on the frame 21 adjacent the stack forming means 25, and two idler pulleys 33 adjustably mounted from the frame 21 that serve to adjust tension in the belts 29 and 30.

The means 23 for holding objects at a transfer location in a layer array includes two spaced horizontal holding extensions 34 of the support plate 31 extending over the delivery ends of the belts 29, 30 to form a holding platform for objects advanced thereto by the belts. Each of the extensions 34 has a short stop flange 36 upstanding from the end thereof. The support plate 31 is mounted on the frame 21 with its top surface underflush of the top surfaces of the belts 29, 30 except at the holding extensions 34, which cover the belts 29 and 30 at the delivery ends of their upper reaches for a distance suitable for accumulating and holding a layer array A of objects ready for transfer therefrom. At the juncture of the holding extensions 34 and the remainder of the support plate 31, the belts 29, 30 pass through the plate 31 and extend thereunder to the pulley 32.

Figure 3:
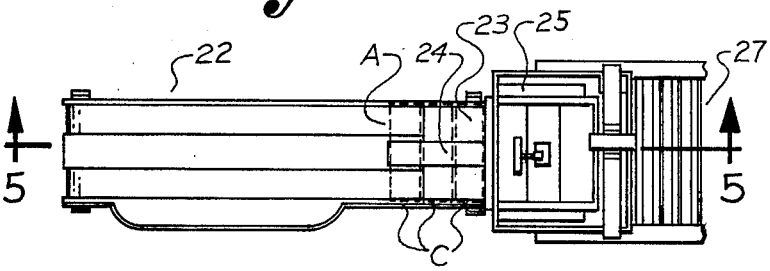
FIG. 3 is a plan view of the case packing apparatus of FIG. 1.
Figure 5:
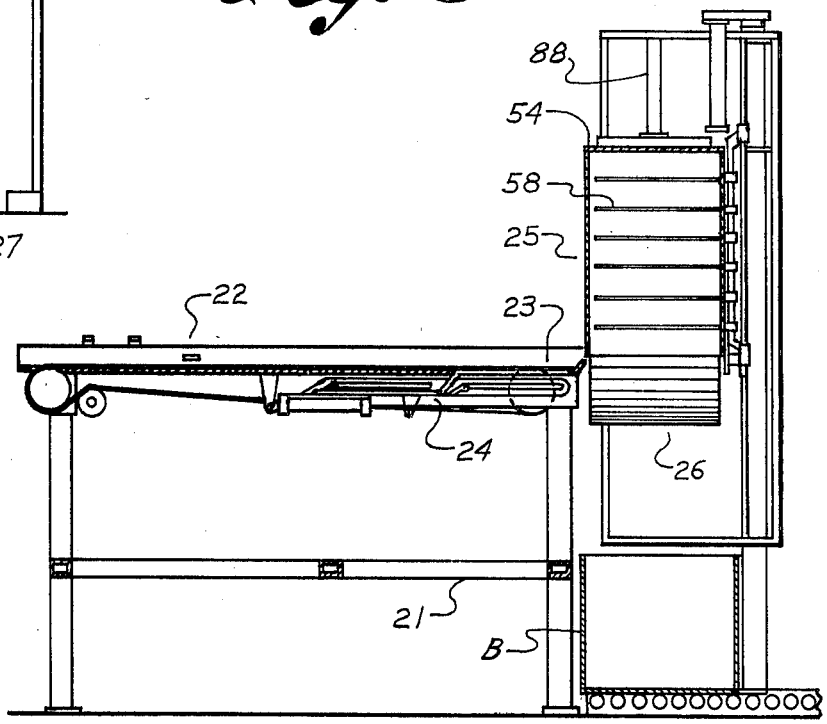
FIG. 5 is a longitudinal sectional view taken along line 5—5 of FIG. 3.

The objects are preferably cartons C that are transported to the plate extensions 34 crosswise on the belts 29, 30 as shown in FIG. 3, and two spaced sensing switches 37 and 38 are disposed adjacent the holding extensions 34 to be actuated by the cartons C held on the holding extensions 34 and to cooperate with a conventional control means 39 to give a signal when a layer array A of three cartons C has accumulated thereon. A pair of parallel upstanding guide rails 35 extend along the sides of the frame 21 above the level of the support plate 31 for guiding the cartons C in line as they advance through the transporting means 22 and onto the holding means 23. The aforementioned sensing switches 37 and 38 are mounted in one of these rails 35.

As shown in FIGS. 6 and 11, means 24 for transferring layer arrays A from the transfer location onto supporting means 40 of the stack forming means 25 includes a transfer plate 41 generally filling the space between the holding extensions 34 and generally flush therewith in a receiving position as shown in FIG. 11. Rollers 42 fixed to the plate 41 ride in matched longitudinal tracks 44 formed in opposite sides of the frame 21. The plate 41 is operated by a fluid piston-cylinder mechanism 56 secured at one end to the front of the frame 21 to advance the plate 41 toward the stack forming means 25 upon a signal from the switches 37, 38. The rollers 42 immediately ride up inclined ramps 48 of the tracks 44, thereby raising the plate 41 above the holding extensions 34 and lifting the array A therewith off the extensions 34 and above the stop flanges 36. Thereafter, the tracks 44 guide the plate 41 to move horizontally toward and into the stacking means 25 at the raised elevation. At the ends of the tracks 44, rollers 42 ride off the elevated portions of the tracks 44, dropping to the lower level 50 for return by action of the cylinder 56 that cycles automatically. During return of the rollers 42 with plate 41 to its receiving position, the rollers 42 near the end of their travel pass under and raise depending pawl-like track segments 52 and move clear of them so that the segments 52 may fall back into place, forming the lower portions of the ramps 48 for the rollers 42 to raise up on during the next cycle to follow generally parallelogram-like paths at each reciprocal cycle of the plate 41 which follows a corresponding parallelogram-like path.

The stack forming and releasing means 25 includes a vertically movable stacker cabinet 54 located above the case B and having vertical walls 56 on which are mounted six sets of retractable support members 58 superposed in positions for receiving and releasably supporting layer arrays A or cartons C thereon in vertically spaced-apart layers and means 59 for manipulating the support members 58 to lower the spaced-apart layers of cartons to form a solid stack S above the case B. Each set of support members 58 is in the form of a pair of opposed spaced horizontal ledges mounted on and extendable inwardly through the opposite walls of the stacker cabinet 54 for receiving and supporting layer arrays A by their lateral undersides and laterally retractable outwardly out of the interior of the cabinet 54 in a sequence for releasing the arrays A sequentially from the top down so that an accumulated solid stack S of cartons is formed and then released by the retraction of the lowermost ledges 58 for the lowest layer array A.

The means 59 for manipulating the support members 58 includes a pneumatic piston-cylinder mechanism 60 mechanically connected thereto and to the cabinet 54 for retraction and extension of each set of ledges 58 and pneumatically connected to a source of air pressure and operably connected to the control means 39 for operation thereby in response to vertical positions of the cabinet 54 as determined by conventional switches suitably located for this purpose. The cabinet 54 is moved vertically by a hydraulic piston-cylinder mechanism 62 operated by oil pressurized by compressed air, conventionally referred to as an air over oil system, and its vertical position is controlled through the control means 39 in response to conventional switches suitably located for positioning the cabinet 54 in a predetermined sequence of movements in which the lowest set of ledges 58 is first positioned extended at a suitable height relative to the transfer means 24 for receiving a layer array A, and thereafter each higher set of ledges 58 in ascending order is so positioned and extended until a preset number of layer arrays A up to six has accumulated in the cabinet 54. The cabinet is locked accurately at each of the receiving positions by an air cylinder operated plunger means 64 mounted on the frame 21 and extendable into a registering hole 65 in cabinet 54, a suitably positioned registering hole being provided for each set of supports 58.

When the cabinet has been lowered to position the topmost set of ledges 58 for receiving a layer array A, which is the position of the cabinet during ledge retraction to form the stack, the cabinet 54 is in a releasing position immediately above the case B suitable for lowering a stack S of cartons thereinto. In the embodiment illustrated only five sets of ledges 58 are used to form a case-filling stack S, with the uppermost set of ledges being unused, but available by control adjustment for use in other stack forming arrangements. The cabinet 54, when it is in its lowermost position, actuates a suitably positioned conventional switch which signals the control means 39 to command the ledges 58 to be withdrawn by the manipulating means 59 to release the solid stack S of cartons C as aforesaid.

The stack S is released onto the means 26 for lowering and releasing it into a case B, and this means 26 comprises a pair of opposed stack engaging means 66 having flexible extents 68 comprised of flexible sheet material and disposed for releasably restraining stacks S in a path of delivery P to the case B, each extent 68 having one end 70 disposed adjacent the path P at the bottom of the cabinet wall and an other end 72 positionable in the path P within the cabinet below the stack S. The extents 68 are deflected partially about a stack S supported thereon in the path P by engagement therewith between ends 70 and 72 as shown in FIG. 9, and thereby gently lowering the supported stack S into the case B. The flexible extents 68 extend through slots in the cabinet walls from rolls 73 of sheet material that are supported exteriorly of the cabinet 54 adjacent the path P on rollers 74 mounted on the lower sides of the cabinet 54 for rotation for unwinding and winding to extend and retract the extents 68 releasable restraint of stacks S.

Figure 10:
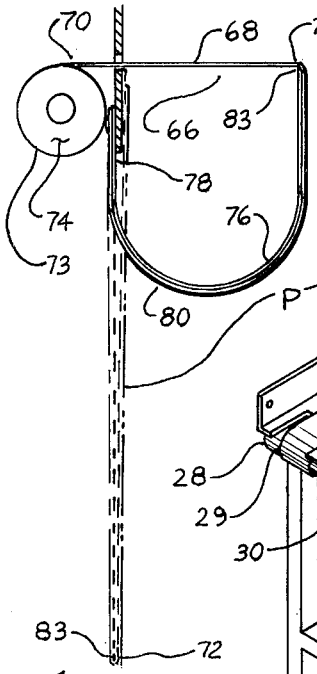
FIG. 10 is an enlarged partial front elevational view of one of the case supporting and releasing assemblies of FIG. 9.

The aforesaid other ends 72 of the flexible extents 68 are supported in the path P by movable means in the form of thin flat springs 76, each having a fixed end portion 78 secured to the outside of the cabinet 54 adjacent the delivery path P generally parallel therewith below the respective extent 68 and contiguously with an enveloping portion 80 of the engaging means 66, which enveloping portions are continuations of the flexible sheet material beyond the flexible extents 68 thereof. The springs 76 have movable end portions 83 engaged by the flexible sheet material at the aforesaid other ends 72 of the flexible extents 68 in the delivery path P. In their initial positions, as shown in solid lines in FIG. 10, the springs 76 are bowed by the tautness of the sheet material into generally upwardly facing adjacent semi-cylinders with the end portions 78, 83 all generally on the same horizontal level and the flexible extents 68 extending generally horizontally. As the flexible extents 68 are extended by unwinding the rolls 73, the other ends 72 of the flexible extents and the movable end portions 83 of the springs 76 move progressively downstream and outwardly with respect to the path P to positions out of the path to relaxed vertical hanging dispositions with the relaxed sheet material enveloping the springs loosely, as shown in light dash lines in FIG. 10. Subsequent winding of the rolls 73 causes the flexible extents 68 to contract against the bias of the springs 76, thereby causing the springs to bow into their initial positions with the flexible extents 68 again in stack receiving position.

With this arrangement, the movable end portions 83 of the springs 76 operate to position the flexible extents 68 for deflecting stack engagement upon release of a stack S onto the flexible extents 68 with the deflecting stack engagements moving progressively downstream and ultimately out of engagement with the stacks P as the extents 68 are extended to vertical positions beside the path P, thereby providing progressive delivery and ultimate release of the stacks S into the cases B. Chain drives 84 fastened in wrapping relation to sprockets 85 connected to the rollers 74 and actuated by a piston-cylinder mechanism 86 mounted on the back of the cabinet 54 serve to wind and unwind the rollers 74 under the bias of the springs 76 on the extents 68 to bow and unbow the springs 76 at the command of the control means 39 which functions in conventionally timed relation to actuate roll unwinding after retraction of the lowermost pair of ledges 58 to release a stack S onto the flexible extents 68 and subsequent winding of the rolls 73 after release of a stack S from the flexible extents 68 into the case B. In this regard, when the enveloped springs 76 extend vertically in relaxed position, they reach essentially to the bottom of the case B and form with the flexible extent 68 and enveloping portion 80 a very thin sandwich of sheet plastic and metal for easy removal from a filled case B, which has walls W closely confining a case filling stack S, when the cabinet 54 is lifted by the automatic return of the piston-cylinder mechanism 62 to its initial layer receiving position to begin the formation of a subsequent stack S.

The flexible extents 68 and the continuing enveloping portions 80 are preferably formed from nylon sheet material about 0.375 mm thick and the springs 76 from spring steel sheet material about 0.375 mm thick, though other materials of similar characteristics could be used to advantage if desired.

During stack formation and stack lowering into the case B any tendency of the cartons C to move out of alignment or to lodge inadvertently in the close fitting cabinet 54 or case B, and to effect an orderly stack formation as well as to provide a downward bias to assist case filling movement of the stack, stabilizing means are provided in the form of a vertically movable horizontal stack stabilizing member or plate 90 disposed above the stack S and maintained in stack stabilizing engagement with the top of the uppermost layer of objects or cartons C during stack forming sequential lowering of the layers to form the stack S and lowering of the stack S into the case B. For this purpose means are provided for maintaining stack engagement in the form of a vertical pressurized piston-cylinder mechanism 88 mounted on the top of the cabinet 54 and supporting and manipulating the stabilizing plate 90 at its lower end. A pad of resilient material 92, such as foamed plastic, is attached to the underside of the plate 90 to cushion engagement with the uppermost layer of cartons therebelow. When in layer engagement, the mechanism 88 applies a light pressure, and reverses to raise the plate simultaneously by the same response that actuates raising of the cabinet 54 after release of a stack S into the case B. Similarly, actuation of the mechanism to move the plate 90 into layer engagement is initiated by the same control that initiates ledge retraction to form the layers into a stack.

Thus, the above-described apparatus has the advantage over the prior art of offering a gentle automatic case filling operation for fragile objects such as eggs in cartons.

The operation of the apparatus is carried out as follows:

Objects, which may preferably be filled egg cartons C, are received from a supply line (not shown) and are carried crosswise on belts 29, 30 until deposited thereby on holding extensions 34, where cartons C accumulate and are pushed toward the stop flanges 36 by the pressure of succeeding cartons C carried along by the belts 29, 30. When a layer array of three cartons C has accumulated into a solid column held on the extensions 34 and has been pushed along to engage both switches 37 and 38 simultaneously, a signal generated thereby in conjunction with the control means 39 actuates a transfer cycle by the transfer means 24. This transfer cycle comprises a first movement included upwardly by the plate 41 to lift the layer array A from its holding position on the extensions 34; a second movement by plate 41 horizontally toward and into the stacker cabinet 54 to a position between and above the lowest set of retractable support ledges 58, which have been prepositioned by cabinet positioning at a predetermined receiving location for receiving layer arrays A, with the ledges 58 extended to receiving dispositions; a third movement inclined downwardly and to a position below and between the support members 58, thereby depositing the array A onto the ledges 58, and a fourth movement of retraction horizontally from the stacker cabinet 54 beneath the transferred array A to the starting position where a suitably located switch is actuated to signal the control means 39 to actuate lowering of the cabinet 54. The cabinet 54 is thereafter automatically lowered to locate the second lowest set of ledges 58 at the predetermined location for receiving layer arrays A and to extend the ledges 58 into receiving position. Then, as soon as another layer array A has accumulated on the holding means 23, a second transfer cycle is initiated for transferring the array A to the support ledges 58. This cycle is repeated five times to form an arrangement of vertically spaced-apart layer arrays A of objects supported on the ledges, following which the cabinet 54 is lowered to the unused sixth ledge position immediately above the case B, at which position a stack forming operation is begun by the control means 39 actuating the vertical piston-cylinder mechanism 88 to lower the stack stabilizing plate 90 under light air pressure to rest on the uppermost layer array A in the cabinet 54. Thereafter, the control means 39 actuates the manipulating means 59 to sequentially retract the support ledges 58 laterally from their supporting positions for each layer in descending order to form a stack S and release the formed stack S by the retraction of the lowest set of support ledges 58 onto the flexible extents 68, which flex slightly under the weight of the stack. The control means 39 then actuates the piston-cylinder mechanism 86 to operate the chain drives 84 to cause the rolls 73 to unwind, extending the flexible extents 68 at a suitable rate for advance of the deflecting engagements of the stack S with the extents 68 progressively downstream of the path P and ultimately out of engagement with the stack S for gentle progressive delivery and final release of the stack S into the case B. The relaxed and vertically downwardly extending springs 76, extents 68, and enveloping portions 80 are then withdrawn from the tight confines between the stack S and the case walls W by vertical upward movement of cabinet 54 to the position for again receiving an intial layer array A on the lowermost set of supports 58; and the extents 68 are concurrently retracted to their stack receiving dispositions.

When handling cartons C as described, the apparatus includes means on the transporting means 22 for sensing the presence of a carton with its lid open and for stopping carton transporting in response to such sensing. This means includes two air jet sensing devices 95 mounted on one of the guide rails 35 above and facing the path of advancing cartons C and spaced longitudinally a distance greater than one closed lid carton width and less than one opened lid carton width so that closed lid cartons will not be under both sensing devices at one time while an opened lid carton will. As the conveyor belts 29, 30 advance cartons faster than they are fed into the belts there is no practical likelihood of two closed lid cartons being under the sensing devices at the same time. When both sensing devices 95 detect the presence of an opened lid carton they provide a signal to the aforementioned motor-pulley units 28 to de-energize the units and stop the belts 29, 30 until an operator removes the opened lid carton, which may be removed from the line or its lid may be closed and it placed on the resumed moving belts for further handling in normal course by the apparatus.

The present apparatus as described for filling cases B with stacks of five layers of egg cartons C, can also be used to fill cases with stacks of six layers of flats. For this purpose the transporting means 22 is adaptable for transporting thirty-egg trays or "flats" T and automatically reorienting each alternate flat for nesting with intermediate flats to form the six layer stack S. A conventional manually operated selector switch is operable to deactivate the aforementioned open lid sensing devices 95 and activate a sensing switch 96 located on the guide rail 35 with a feeler arm extending therethrough for sensing the presence of a leading corner of a tray T supported and conveyed on the belts 29, 30 in position for pivoting reorientation. To accomplish tray pivoting, the switch 96 deactivates the motor pulley unit 28 for the adjacent belt 29 while allowing the motor pulley unit 28 for the far belt 30 to continue operating. Thus, the adjacent belt 29 temporarily stops for a predetermined time interval while the far belt 30 continues to run, thereby pivoting the tray T until the leading corner originally on the far belt 30 moves against the guide rail 35 carrying the switch 96 to thereby reorient the tray T 90°, after which the belt 29 is restarted and both belts convey the reoriented tray T to the transfer means 24. A cam member 100, preferably formed of lowfriction plastic, is provided on the support plate 31 in the approximate location of tray reorientation under the belt 30, as shown in FIG. 11, for elevating the belt 30 slightly for enhanced frictional engagement of trays T carried thereon to assure pivoting reorientation movement thereby. A wedge shaped camming member 101, preferably formed of low-friction plastic, is also provided on the support plate 31 at a location inwardly of the belt 29 at the location where the leading pivoting corner of the tray T being reoriented must pass over the edge of belt 29, to facilitate such passage without catching on the belt edge.

The aforesaid tray sensing switch 96 is connected to the associated motor pulley unit 28 to stop the belt 29 only upon alternate tray sensing so as to reorient only alternate trays T. This alternate reorienting allows the trays to be oriented for proper nesting in stacks when the trays are of the conventional type having five rows of six eggs per row and are originally fed to the apparatus all in the same orientation, which allows nesting of empty trays but requires alternate reorientation for nesting when filled with eggs.

After the above alternate reorientation, the trays T are transported to the holding means 23 where their presence is sensed by the switches 37, 38 as any other layer array A, and are handled thereafter as previously described except that the criss-crossed egg patterns on the trays T allow them to nest together with less vertical space required per layer than with egg cartons C, so that six layers are normally required to fill a case B, and these six trays T provide the same number of eggs E (fifteen dozen) as provided by five layers of three one-dozen egg cartons C per layer. The control means 39 is adapted for ready changeover to form a stack S of six layers by the apparatus, the only difference in operation is that the cabinet 54 is in stack release position after the accumulation of six layer arrays A, so that the operation of lowering the cabinet 54 an additional step to an unused ledge position is replaced by the sixth tray transferring operation.

The various embodiments of the present invention have individual advantages which enhance each other when used in the complete case packing apparatus as described herein, but they may be equally advantageous when used alone for certain purposes, or when used in combination with other devices or apparatus for diverse purposes. Therefore, it is not intended that the use of these embodiments be limited to the combinations set forth herein or to the purposes described here.

Further, the various arrangements of switches and controls may be varied extensively within the skill in the art and for the reason that all of these, as well particularly as the control means 39, may be of any conventional construction, the present disclosure is not burdened with specific details that would be obvious to one skilled in the art.

The present invention has been described in detail above for purposes of illustration only and is not intended to be limited by this description or otherwise to exclude any variation or equivalent arrangement that would be apparent from, or reasonably suggested by, the foregoing disclosure to the skill of the art. The invention is intended to be limited only by the scope of the appended claims.

I claim:

1. Case packing apparatus comprising means for releasably supporting a plurality of objects in vertically spaced layers above an object receiving case, means for manipulating said supporting means to lower the spaced layer of objects sequentially from the top down to form a solid stack above the case, and means for lowering the stack into the case and releasing the stack thereinto, said stack lowering means being retractable from the case after stack release.

2. Case packing apparatus according to claim 1 and characterized further in that said manipulating means manipulates said supporting means to form a solid stack of case-filling size, and said lowering and releasing means releases the stack into the bottom of the case.

3. Case packing apparatus according to claim 1 and characterized further by means for transporting objects to a transfer location, means for holding objects at said transfer location in a layer array, and means for transferring layer arrays from said transfer location onto said supporting means.

4. Case packing apparatus according to claim 1 and characterized further in that said releasably supporting means comprises a plurality of sets of retractable support members superposed in positions for receiving and supporting objects by their lateral undersides in vertically spaced-apart layers, and said manipulating means retracts said support members sequentially from the top down.

5. Case packing apparatus according to claim 4 and characterized further in that said sets of retractable support members are assembled on a vertically movable stacker cabinet, and by means for moving said cabinet vertically to position said sets of support members successively at a predetermined location for reception of objects thereat.

6. Case packing apparatus according to claim 4 and characterized further by means for transferring objects in layer arrays from a transfer location onto said support members, and in that said support members of each set are spaced apart to accommodate movement of said transferring means therebetween.

7. Case packing apparatus according to claim 1 and characterized further in that said stack lowering and releasing means comprises a pair of opposed stack engaging means having flexible extents disposed for releasably restraining stacks in a path of delivery to the case, said flexible extents each having an end disposed adjacent the path of delivery and an other end positionable in the path of delivery, said extents being flexible between the respective ends for stack restraining deflection partially about stacks in the path upon engagement therewith, movable means supporting said other ends of said flexible extents in the path of delivery and being operable to position the other ends peogressively downstream and outwardly with respect to the path of delivery to positions out of the path for advance of the deflecting stack engagements progressively downstream and ultimately out of engagement with the stacks for lowering of the flexible extents to vertical positions adjacent the path, thereby providing progressive delivery and ultimate release of the stacks into the case.

8. Case packing apparatus according to claim 7 and characterized further in that the flexible extents of said stack engaging means are formed of flexible sheet material and are extendable from the ends of said extents adjacent the path of delivery, in that said movable means comprises thin flat springs having fixed end portions secured adjacent the delivery path generally parallel therewith and having movable end portions engaged by said flexible sheet material at said ends of said flexible extents that are positionable in the delivery path, means for varying said flexible extents to cause bowing and unbowing of said springs to position said flexible extent ends in and downstream out of the delivery path, and in that the case is defined by walls confining the stacks whereby in said positions out of the delivery path the flexible extents and respective flat springs lie flat in removable disposition between the stacks and the walls.

9. Case packing apparatus according to claim 8 and characterized further in that said means for varying said flexible extents includes rolls of said flexible sheet material disposed adjacent the delivery path for providing said flexible extents, and means for unwinding and winding said rolls to extend and retract said flexible extents.

10. Case packing apparatus according to claim 1 and characterized further by means for transporting objects, and means for transferring objects in layers from said transporting means onto the said supporting means in consecutive layers, said means for transporting objects including means located in advance of said transferring means for horizontally reorienting alternate objects being transported and passing the other objects in original orientation for nesting of said alternate objects with said other objects upon forming said solid stack.

11. Case packing apparatus according to claim 10 and characterized further in that said transporting means comprises a pair of parallel conveyor belts for supporting and conveying common objects and means for driving one belt while temporarily stopping the other to cause pivoting reorienting of the object being transported.

12. Case packing apparatus according to claim 11 and characterized further by a cam member under said one belt to elevate the belt for enhanced frictional engagement of objects to assure movement therewith.

13. Case packing apparatus according to claim 1 and characterized further by a horizontally disposed vertically movable stack stabilizing member and means for maintaining said stack stabilizing member in engagement with the top of the uppermost layer of objects during stack forming sequential lowering of the layers.

14. Case packing apparatus according to claim 13 and characterized further in that said stack stabilizing member includes a horizontal plate having a pad of resilient material attached to its underside for engagement with said uppermost layer, and said maintaining means comprises a pressurized piston-cylinder mechanism acting downwardly on said plate to maintain a stack stabilizing pressure therethrough onto the stack.

* * * * *